US006135711A

United States Patent [19]

Binder

[11] Patent Number: 6,135,711

[45] Date of Patent: Oct. 24, 2000

[54] TURBINE BLADE ASSEMBLY

[76] Inventor: Carsten Binder, Hof 1, 9473 Gams, Switzerland

[21] Appl. No.: 09/060,006

[22] Filed: Apr. 14, 1998

[30] Foreign Application Priority Data

Apr. 17, 1997 [DE] Germany ..... 197 15 966

[51] Int. Cl.[7] ..... F01D 9/04

[52] U.S. Cl. ..... 415/209.3; 415/210.1

[58] Field of Search ..... 415/209.2, 209.3, 415/209.4, 210.1; 29/889.2, 889.7, 889.71

[56] References Cited

U.S. PATENT DOCUMENTS

| | | | |
|---|---|---|---|
| 925,218 | 6/1909 | Nikonow | 415/209.3 |
| 2,771,622 | 11/1956 | Thorp | 415/209.4 |
| 3,365,173 | 1/1968 | Lynch et al. | 415/209.3 |
| 5,022,818 | 6/1991 | Scalzo | 415/209.3 |

FOREIGN PATENT DOCUMENTS 19 02 031 10/1964 Germany .

23 20 064 11/1974 Germany .

OTHER PUBLICATIONS

Patents Abstracts of Japan, M–1717 Dec. 6, 1994, vol. 18/No. 640, Waterdrop Removing Device For Steam Turbine, 6–248903 (A), Appl. No. 5–35783, Toshiba Corp. Taro Sakamoto,

*Primary Examiner*—Edward K. Look
*Assistant Examiner*—Rhonda Barton
*Attorney, Agent, or Firm*—Henry M. Feiereisen

[57] ABSTRACT

A blade assembly for use in a steam turbine having a housing, includes a plurality of circumferentially aligned and spaced-apart hollow blade members which have each a base and a head piece and are so arranged in the housing of the turbine as to form an inner ring and an outer ring. Each blade member is made of sheet metal and forms with the base and the head piece a uniform weldment, with the base of all blade members being suspended from stationary receptacles of the turbine housing.

13 Claims, 3 Drawing Sheets

TURBINE BLADE ASSEMBLY

BACKGROUND OF THE INVENTION

The present invention generally relates to a blade assembly for steam turbines, and more particularly to a blade assembly including a plurality of circumferentially aligned and spaced apart hollow blade members which have each a base and a head piece and are so arranged in the housing of the turbine as to form an inner ring and an outer ring.

Such blade assemblies are generally fabricated in two ways. In accordance with a first type of fabrication, the blade assemblies are made from malleable cast iron, and in a second mode of fabrication, the actual blade members are made from sheet metal and welded within outer and inner half-round rings. Blade assemblies made from malleable cast iron are characterized by a substantial weight and thus cost-intensive material use. Moreover, in order to keep predetermined tolerances, complex finishing works and required especially when using such high quality cast types as e.g. malleable cast iron. Still, despite thorough and careful grinding operation, the texture and surface of such components is inferior in comparison to ground surfaces of sheet metal components. As a consequence, also the corrosion-resistance is adversely affected and thus the longevity of the product. Compared to sheet metal constructions, cast components have another relevant drawback which resides in their inability to form a flow separation edge of sufficiently acute angle, so that their effectiveness considerably deteriorates.

Blade assemblies made by way of the second type of fabrication have also several drawbacks. The sequential welding of the blade members into the half-round rings results in significant tensions or distortions and dimensional variations that can only eliminated through complex operations because the outer and inner half-round rings absorb different amounts of energy, compounding imbalances as a result of the afore-stated problems. Apart therefrom, radial variations in dimensions by itself pose a problem.

SUMMARY OF THE INVENTION

It is thus an object of the present invention to provide an improved blade assembly, obviating the afore-stated drawbacks.

In particular, it is an object of the present invention to provide an improved blade assembly which is of relatively light configuration and thus cost-efficient and requires only minor finishing operations when experiencing distortions during fabrication, while yet allowing fabrication of guide blades which have surfaces and flow separation edges that not only exhibit resistance to corrosion but ensure an extended service life at high degree of efficiency.

These objects, and others which will become apparent hereinafter, are attained in accordance with the present invention by making each of the blade members hollow in shape and of sheet metal and so forming the blade members with the base and the head piece as to provide a uniform weldment, with the base of all blade members being secured in stationary receptacles of the turbine housing.

Thus, the present invention in effect proposes a third type of fabrication for a blade assembly, i.e. a weldment, that has the advantage of allowing forces to be directed from the site of origin to the support area within a narrow space or via a short path, thereby reducing the material use and the overall weight. As the blades are comprised of single components, application of sheet metal of different strength is suitable so that the use of e.g. high quality sheet metal permits a further weight reduction. If provision of light blade members is of no concern, the head pieces and the bases may then be fabricated from inexpensive and respectively strong sheet metal such as boiler plates. A further advantage of a weldment is the capability to fabricate the actual blade without base and head piece from a single type of sheet metal that has a smooth surface so as to offer only slight resistance to impacting steam, and exhibits a high corrosion resistance as a consequence of the fine structure throughout so as to positively affect the operativeness, thereby providing for an extended service life. Welding operations are suitably executed in stable devices so as to minimize distortions and tolerance deviations which can easily be eliminated through grinding.

Thus, by providing a blade assembly in accordance with the present invention through welding together the individual components, a third way of fabrication is proposed, whereby the blade members can be provided with an acute flow separation edge to generate a high degree of efficiency and can be so shaped as to cope with radial dimensional variations. Thus, the drawback associated with fabrication of hollow blades of sheet metal welded into half round rings can now effectively be eliminated. Suitably, the blade assembly is pushed into the stationary receptacles, e.g. a circumferential undercut groove of the turbine housing so as to further enhance the effectiveness of the blade assembly as the blade assembly is suspended from the housing, without encountering welding heat.

According to another feature of the present invention, the base and the head piece of each blade member are each formed by, preferably two, boiler plates arranged in opposite disposition and so connected to one another as to form stable constructions, with one of the boiler plates of the base and one of the boiler plates of the head piece defining inner plates in opposite disposition and forming weld-on plates for the end faces of the hollow blades. This arrangement has the advantage that the head pieces and the bases can first be fabricated for subsequent welding of the actual guide blades. As a consequence, distortions are minimized so that the finishing process is facilitated. The use of webs, formed parts, strips or the like for connecting the plates allow fabrication of hollow members which are extremely stable at least in two directions, especially since the application of strips enable to influence the stability.

Suitably, the other one of the boiler plates of each head piece, spaced from the weld-on plate, has a contour complementing the ring surface of the rotor, with the inner ring of the blade assembly and the ring surface of the rotor being sealed from one another, e.g. via a labyrinth seal of any suitable configuration.

According to another feature of the present invention, each head piece is formed with a radially outwardly directed separation wall between the linked boiler plates for allowing a bracing of separation walls of neighboring like headpieces, e.g. by a rope that is passed through respective holes in the separation walls.

Preferably, the inner weld-on plate of each base has an inner surface forming a steam guiding area, with the base having an outer configuration exhibiting curved surfaces for securement in the turbine housing. In this manner, a single structure fulfills two functions, namely steam conduction and anchoring in the turbine housing.

In order to minimize unavoidable distortions, it is suitable to apply laser welding for fabricating the blades because laser welding not only results in welded joints that are of especially high quality and capable of withstanding high stress but can be executed at reduced energy supply.

Attachment of the blade assembly is preferably attained by designing the housing in two-part configuration, with the housing parts defining a continuous circumferential undercut groove for receiving the blade assembly.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
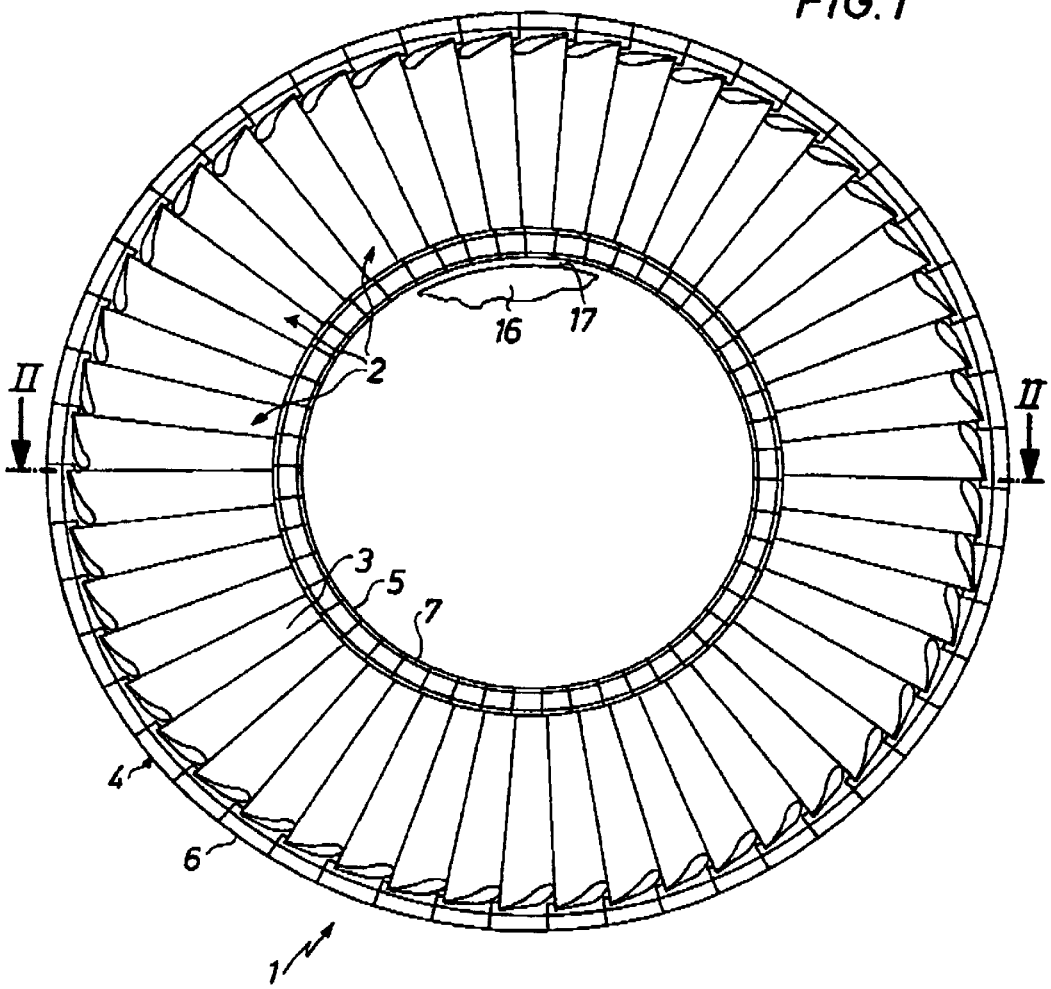
FIG. 1 is a plan view of one embodiment of a blade assembly according to the present invention.

Throughout all the Figures, same or corresponding elements are generally indicated by same reference numerals.

Figure 2:
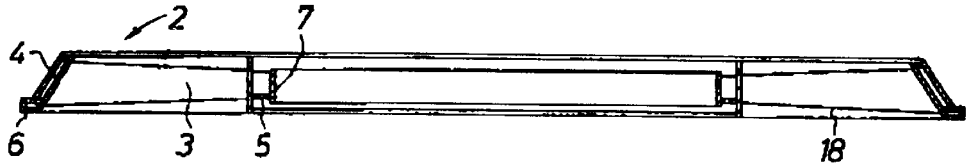
FIG. 2 is a sectional view of the blade assembly, taken along the line II—II in FIG. 1.

Turning now to the drawing, and in particular to FIGS. 1 and 2, there are shown a plan view and a sectional view of one embodiment of a stator in the form of a fixed blade assembly according to the present invention, generally designated by reference numeral 1 for use in a steam turbine. The blade assembly 1 includes a plurality of circumferentially aligned and spaced-apart blade members, generally designated by reference numeral 2. Each blade member 2 is comprised of an actual guide blade 3 having one end welded to a base 4 and another end welded to a head piece 5, with the head pieces 5 of neighboring blade members 3 forming a radially outer ring 6 and the bases 4 of neighboring blade members 3 forming a radially inner ring 7. Thus, each blade member 2 forms a weldment comprised of blade 3, base 4 and head piece 5 which components are welded together to define a single structural unit. Symbol W in the drawings represents a weld portion.

Cooperating with the stator of the steam turbine is a rotor 16 which is only indicated in FIG. 1 by way of a fragmentary section. The rotor 16 defines a ring surface 17 whereby the inner ring 7 of the blade assembly 1 is spaced from the ring surface 17 at formation of an air gap and sealed therefrom via a suitable labyrinth seal (not shown).

Figure 3:
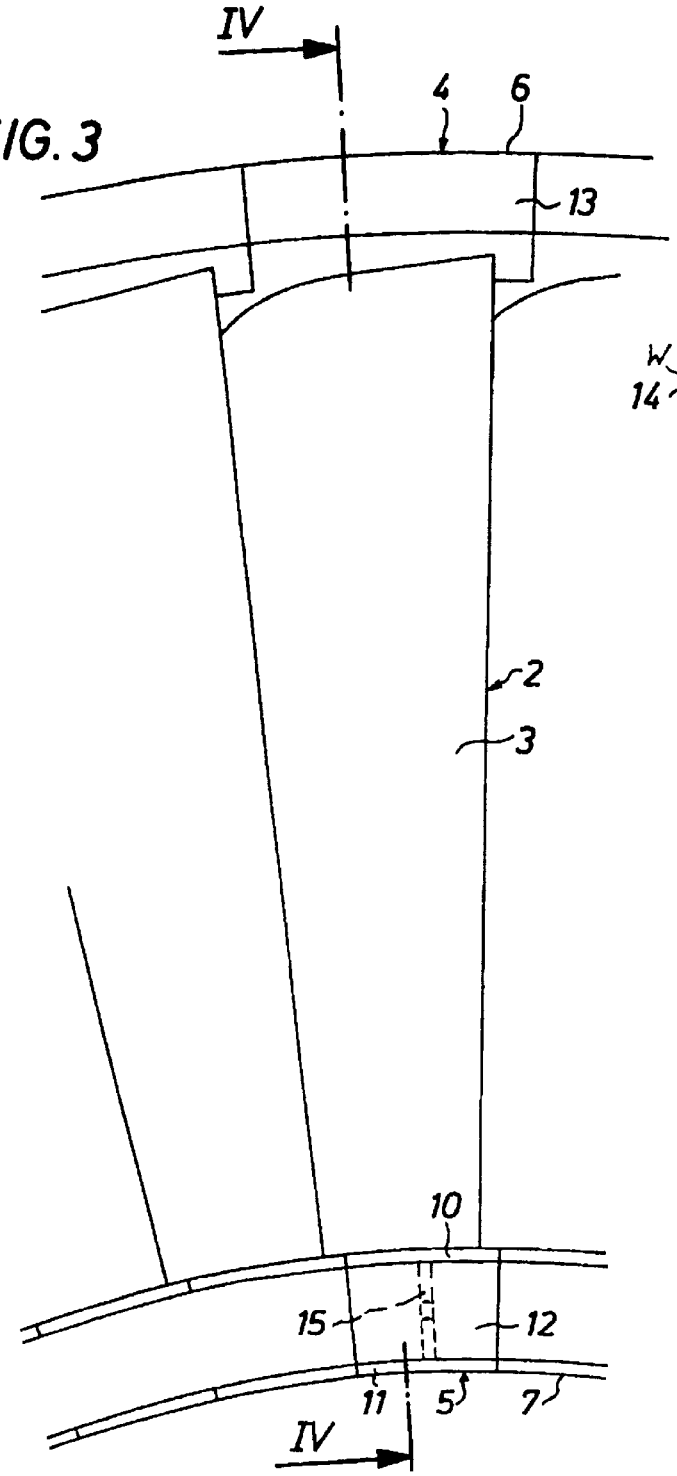
FIG. 3 is a schematic illustration, on an enlarged scale, of a blade member of the blade assembly of FIG. 1, with neighboring blade members shown only fragmentary.
Figure 4:
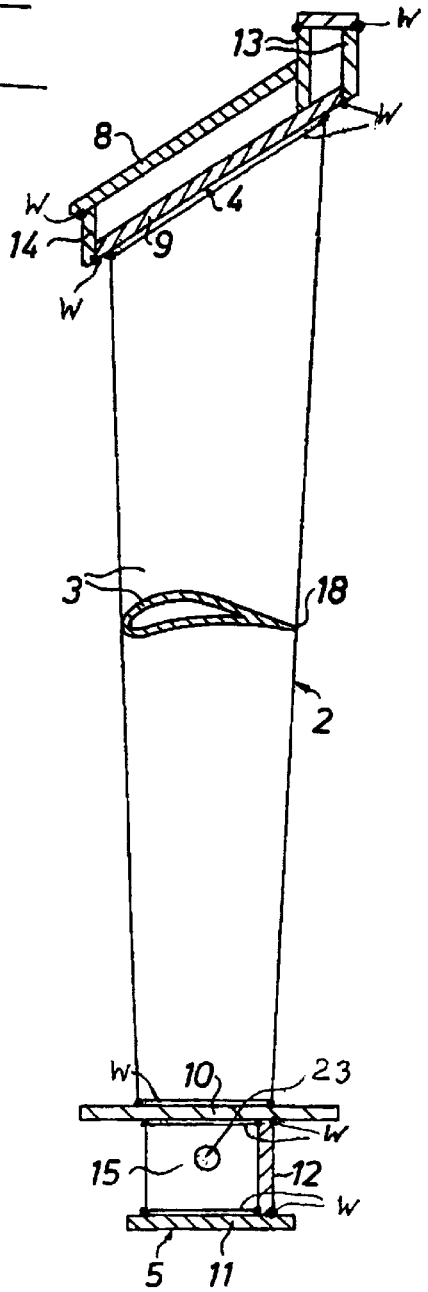
FIG. 4 is a sectional view of the blade member, taken along the line IV—IV in FIG. 3.

As shown in particular in FIGS. 3 and 4, the base 4 of each blade member 2 is formed by two plates 8, 9 arranged in opposite disposition and so connected on one end by a web 14 and on the other end by webs 13 as to be able to withstand high loads. Likewise, the head piece 5 of each blade member 2 is formed by two plates 10, 11 in opposite disposition which are so connected on one end by a web 12 as to be able to withstand high loads. The head pieces 5 and the bases 4 may also be designed of such curved configuration as to create polygonal rings 6, 7. The plate 9 of the base 4 is also configured to form a baffle area for a fluid flow. The head piece 5 is further provided with a radial separation wall 15 which is formed with a hole 23 for allowing bracing of neighboring head pieces 5, e.g. by passing a respective rope through the holes 23 in the walls 15 of neighboring head pieces 5.

As best seen in FIG. 4, the blade 3 is so shaped as to form an acute and pointed flow separation edge 18 to effect a high degree of efficiency.

Figure 5:
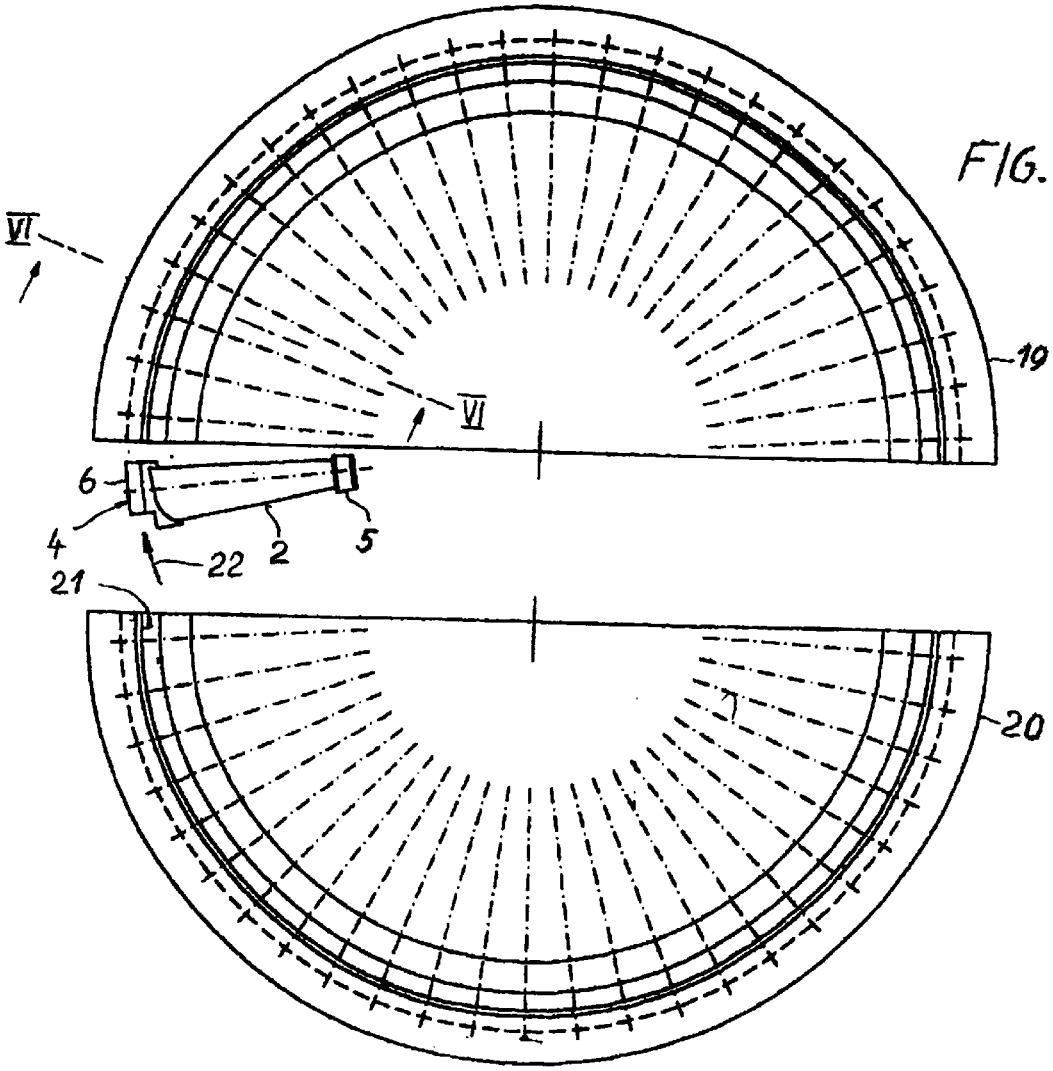
FIG. 5 is a plan view of a turbine housing, in exploded illustration, for attachment of the blade assembly of FIG. 1.
Figure 6:
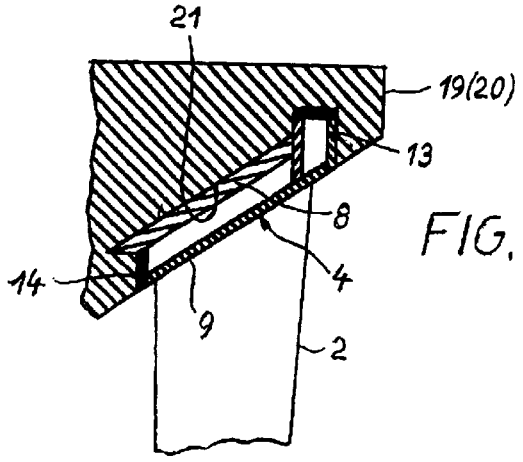
FIG. 6 is a fragmentary, partial sectional view of the housing, taken along the line VI—VI in FIG. 5, showing in detail the attachment of a blade member.

Turning now to FIG. 5, there is shown a plan view of a turbine housing, in exploded illustration, for receiving the blade assembly 1. The turbine housing is of two-part structure with housing parts 19, 20 which are formed with a circumferential undercut groove 21. As shown in particular in conjunction with FIG. 6, the bases 4 of the blade members 2 are pushed into the undercut groove 21 in a direction indicated by arrow 22 until filling the entire housing 19, 20 and suspended therefrom, as indicated in dashdot lines in FIG. 5. Persons skilled in the art will understand that the blade members 2 may also be attached to the housing 19, 20 in a different manner so long as no welding operation is executed.

While the invention has been illustrated and described as embodied in a turbine blade assembly, it is not intended to be limited to the details shown since various modifications and structural changes may be made without departing in any way from the spirit of the present invention.

What is claimed as new and desired to be protected by letters patent is set forth in the appended claims:

1. A blade assembly for use in a steam turbine having a housing, comprising a plurality of circumferentially aligned and spaced apart hollow blades which have each a base and a head piece and are so arranged in the housing of the turbine as to form an inner ring and an outer ring, each of said blades being made of sheet metal and forming with the base and the head piece a uniform weldment, with the base secured in a stationary receptacle of the housing of the turbines wherein each of the base and the head piece of each blade includes a plate defining an inner weld-on plate, said inner weld-on plate of the base and said inner weld-on plate of the head piece defining end faces of the blade.

2. The blade assembly of claim 1 wherein each of the base and the head piece of each blade includes another plate arranged in confronting disposition to the weld-on plate and connected thereto so as to form a stable construction.

3. The blade assembly of claim 2, with the turbine having a rotor defining a peripheral ring surface at a distance to the inner ring, and a stator including the blade assembly, wherein the other plate of each head piece, spaced from the weld-on plate, has a contour complementing the ring surface of the rotor for effecting a seal between the stator and the ring surface of the rotor.

4. The blade assembly of claim 2 wherein each head piece is formed with a separation wall extending radially outwardly between the connected plates and adapted for allowing a bracing with separation walls of neighboring head pieces.

5. The blade assembly of claim 2 wherein the inner weld-on plate of each base has an inner surface forming a steam guiding area, said base having an outer configuration exhibiting curved surfaces for securement in the housing.

6. The blade assembly of claim 1 wherein the weldment is effected through laser welding.

7. The blade assembly of claim 1, with the housing of the steam turbine being designed in two parts and formed with a circumferential undercut groove for securely receiving the blades.

8. A blade assembly for use in a steam turbine having a housing, comprising a plurality of circumferentially aligned and spaced apart hollow blades which have each a base and a head piece and are so arranged in the housing of the turbine as to form an inner ring and an outer ring, each of said blades being made of sheet metal and forming with the base and the head piece a uniform weldment, with the base secured in a stationary receptacle of the housing of the turbine, wherein each of the base and the head piece of each blade includes two interconnected plates.

9. The blade assembly of claim 8, with the turbine having a rotor defining a peripheral ring surface at a distance to the inner ring, and a stator including the blade assembly, wherein one of the plates of each head piece has a contour complementing the ring surface of the rotor for effecting a seal between the stator and the ring surface of the rotor.

10. The blade assembly of claim 8 wherein each head piece is formed with a separation wall extending radially outwardly between the interconnected plates and adapted for allowing a bracing with separation walls of neighboring head pieces.

11. The blade assembly of claim 8 wherein one of the plates of each base has an inner surface forming a steam guiding area, said base having an outer configuration exhibiting curved surfaces for securement in the housing.

12. The blade assembly of claim 8 wherein the weldment is effected through laser welding.

13. The blade assembly of claim 8, with the housing of the steam turbine being designed in two parts and formed with a circumferential undercut groove for securely receiving the blades.

* * * * *